US008726814B1

(12) United States Patent
Matteo

(10) Patent No.: US 8,726,814 B1
(45) Date of Patent: May 20, 2014

(54) CONVERTIBLE WORKSTATION

(76) Inventor: Salvatore Matteo, Los Angeles, CA (US)

( * ) Notice: Subject to any disclaimer, the term of this patent is extended or adjusted under 35 U.S.C. 154(b) by 546 days.

(21) Appl. No.: 12/699,068

(22) Filed: Feb. 3, 2010

Related U.S. Application Data

(60) Provisional application No. 61/172,650, filed on Apr. 24, 2009.

(51) Int. Cl.
*A47B 37/00* (2006.01)

(52) U.S. Cl.
USPC ..... 108/50.02; 108/116; 248/157; 248/166; 248/292.12

(58) Field of Classification Search
USPC ..... 108/50.01, 50.02, 115–116, 128, 145; 248/129, 136, 150, 157, 165–166, 248/276.1, 280.11, 281.11, 292.12
See application file for complete search history.

(56) References Cited

U.S. PATENT DOCUMENTS

| | | | | |
|---|---|---|---|---|
| 3,638,973 | A * | 2/1972 | Poletti | 285/184 |
| 4,778,216 | A * | 10/1988 | Stupakis | 297/17 |
| 5,435,620 | A * | 7/1995 | Cheng | 297/51 |
| 5,890,690 | A * | 4/1999 | Klintberg | 248/276.1 |
| 5,898,817 | A * | 4/1999 | Salmon et al. | 392/418 |
| 6,334,687 | B1 * | 1/2002 | Chino et al. | 353/79 |
| 7,100,880 | B2 * | 9/2006 | Oddsen, Jr. | 248/278.1 |
| 7,118,080 | B2 * | 10/2006 | Chan et al. | 248/129 |
| 7,258,321 | B1 * | 8/2007 | Storrs | 248/251 |
| 7,369,672 | B2 * | 5/2008 | Hirschhorn | 381/333 |
| 7,597,302 | B2 * | 10/2009 | Lee et al. | 248/371 |
| 7,639,484 | B2 * | 12/2009 | Chen et al. | 361/679.26 |
| 7,959,120 | B2 * | 6/2011 | Liao | 248/278.1 |
| 8,020,818 | B2 * | 9/2011 | Chou et al. | 248/176.1 |
| 8,136,773 | B2 * | 3/2012 | Schmutzer et al. | 248/125.8 |
| 8,191,487 | B2 * | 6/2012 | Theesfeld et al. | 108/144.11 |
| 2003/0154890 | A1 * | 8/2003 | Warner | 108/145 |
| 2004/0159757 | A1 * | 8/2004 | Pfister | 248/284.1 |
| 2006/0054751 | A1 * | 3/2006 | Johnson et al. | 248/123.11 |
| 2006/0192901 | A1 * | 8/2006 | Hurd | 348/825 |
| 2007/0089648 | A1 * | 4/2007 | Harrison et al. | 108/115 |
| 2007/0256611 | A1 * | 11/2007 | Huang | 108/116 |

* cited by examiner

*Primary Examiner* — Hanh V Tran
(74) *Attorney, Agent, or Firm* — Michael D. Eisenberg

(57) ABSTRACT

A convertible work station is operable to convert between an operating configuration and a storage configuration. The work station comprises: right and left base shoulder elements; right and left horizontal base members for supporting the work station on a surface, pivotally connected to the shoulder elements and constrained to pivot along a horizontal plane and lockable in position relative to the shoulder elements; right and left first support members spaced apart from each other and having first and second ends and the support members being pivotally connected to the respective right and left shoulder elements at their first ends and constrained to pivot in one direction. The support members are lockable in position relative to the shoulder elements. A work station component is pivotally connected to the second ends of the right and left support members.

12 Claims, 28 Drawing Sheets

CONVERTIBLE WORKSTATION

CROSS-REFERENCES TO RELATED APPLICATIONS

This application claims priority from U.S. Provisional Application Ser. No. 61/172,650 filed Apr. 24, 2009, which is hereby incorporated herein by reference in its entirety.

TECHNICAL FIELD

The present invention relates to support devices for interactive or passive computing or digital media, and more particularly, some embodiments relate to a computer work station for supporting the physical components.

BACKGROUND OF THE INVENTION

The present invention addresses needs of economizing on space and improving the mobility of computer equipment and digital media such as monitors and projectors, by providing an improved structure for holding the computing equipment and input devices such as computer keyboards and mice, and in an aesthetically pleasing manner.

BRIEF SUMMARY OF EMBODIMENTS OF THE INVENTION

According to one embodiment of the invention, a convertible work station is operable to convert between an operating configuration and a storage configuration. The work station comprises: right and left base shoulder elements; right and left horizontal base members for supporting the work station on a surface, pivotally connected to the shoulder elements and constrained to pivot along a horizontal plane and lockable in position relative to the shoulder elements; right and left first support members spaced apart from each other and having first and second ends and the support members being pivotally connected to the respective right and left shoulder elements at their first ends and constrained to pivot in one direction. The support members are lockable in position relative to the shoulder elements. A work station component is pivotally connected to the second ends of the right and left support members. The work station converts between the operating and storage configuration via the pivotable connections between the should arms and the support members and base members.

In a variant of the convertible work station, the work station component comprises right and left second support arms pivotally connected at their first ends to the respective seconds ends of the right and left first support members, and is constrained to pivot in the same plane as the first support members. A third support arm is pivotally connected at its first end between the right and left second support arms at their second ends. An attachment piece is connected to the third support arm at its second end for connecting a work station object to the work station. A plurality of locking mechanisms are provided for locking the pivotable connections in place. The work station converts between the operating and storage configurations via the pivotable connections.

In a further variant of the convertible multimedia work station, the work station component comprises a platform connected to the work station between the first support arms at the second ends of the first support arms.

In still another variant, the convertible work station comprises a display connected to the workstation between the first support arms and between the left and right shoulder elements.

In yet a further variant, the convertible multimedia work station comprises a computer hardware case containing a processing unit and memory, wherein the computer hardware case is connected to the workstation between the first support arms and between the left and right shoulder elements along a bottom edge of the hardware case.

In another variant, the convertible work station comprises a platform connected to the workstation between the first support arms and between the left and right shoulder elements.

In a further variant of the convertible work station, the work station component comprises a curved member having two ends connected between the first support members, configured for attaching a work station object at either end of the curved member.

In still another variant of the convertible work station, the curved member has one end attached to a display and a second end to attached a platform. The curved member is connected between the first and second support members and is pivotable between the first support members and lockable in a desired position.

In yet a further variant, a universal support member comprises: two identical ends, the ends comprising: a first circular perimeter configured for engaging another universal support member's end. The first circular perimeter defines a plane that faces perpendicular to a long dimension of the support member. A second circular perimeter is configured for engaging another universal support member's end. The second circular perimeter defines a plane that faces perpendicular to a long dimension of the support member. A hollow interior allowing passage is disposed between the first and second circular perimeters. A shaft is connected between the ends and has a channel.

In another variant, a convertible work station is constructed with the universal support members and is operable to convert between an operating configuration and a storage configuration. The work station comprises: right and left base shoulder elements; right and left horizontal base members for supporting the work station on a surface, pivotally connected to the shoulder struts and constrained to pivot along a horizontal plane and lockable in position relative to the shoulder elements; right and left first support members spaced apart from each other and having first and second ends, the support members being pivotally connected to the respective right and left shoulder elements at their first ends and constrained to pivot in one direction, the support members lockable in position relative to the shoulder elements; and a work station component pivotally connected to the second ends of the right and left support members. The horizontal base members and the first support members are comprised of the universal support members. The work station converts between the operating and storage configuration via the pivotable connections between the should arms and the support members and base members.

In a further variant, a work station comprises: two support members comprised of the support members; a computer hardware case containing a processing unit, memory and network hardware, disposed between the two support members; and an attachment piece connected to the work station and disposed between the support members at first ends of the members and configured for connecting a display to the work station.

In still another variant, a plurality of work stations are provided, wherein the work stations are connected to a stationary support cylinder at their second ends, the work stations further comprising a platform connected to an end of the attachment piece.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

Figure 1:
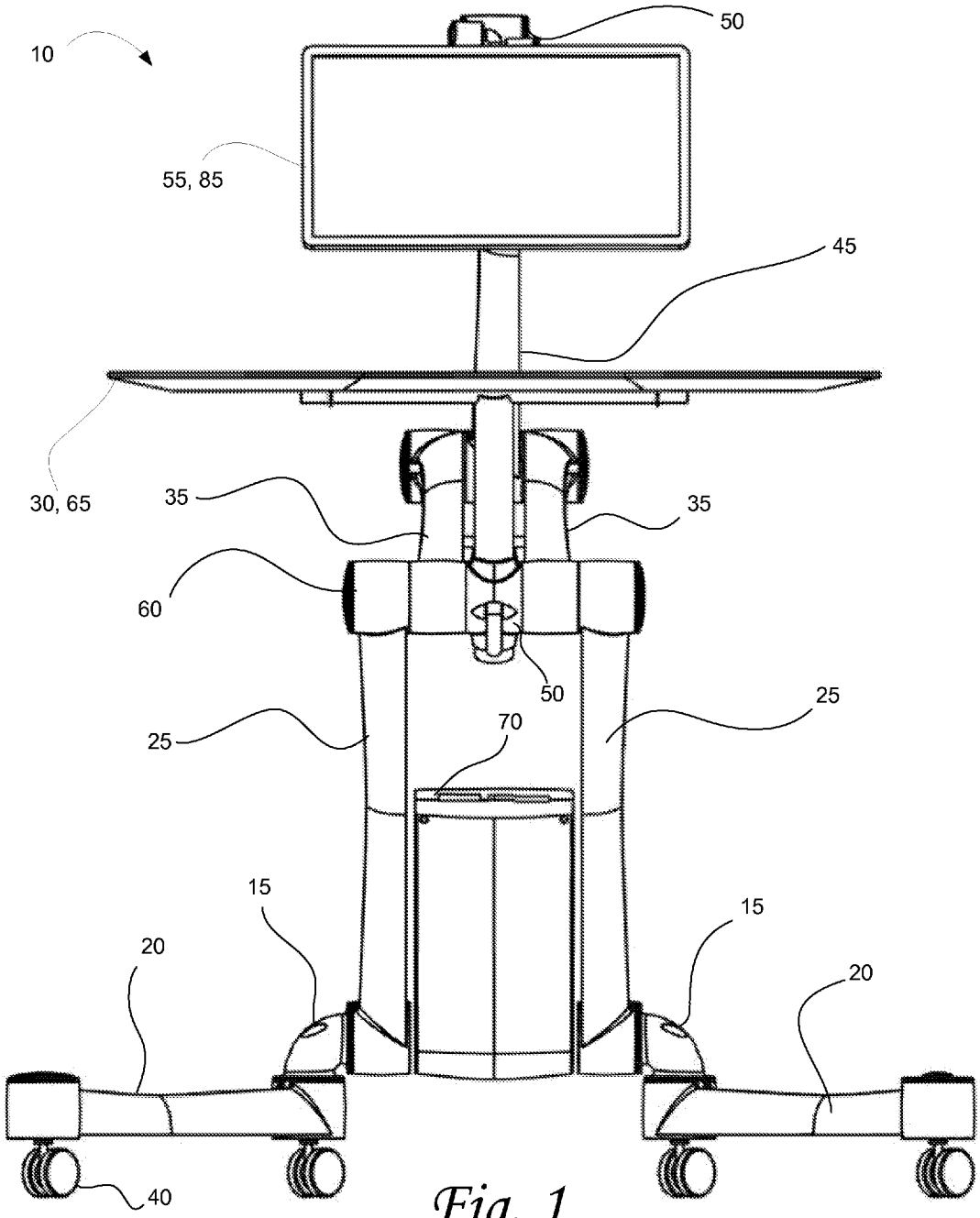
FIG. 1 is a front view of a preferred workstation in accordance with the principles of the invention.
Figure 2:
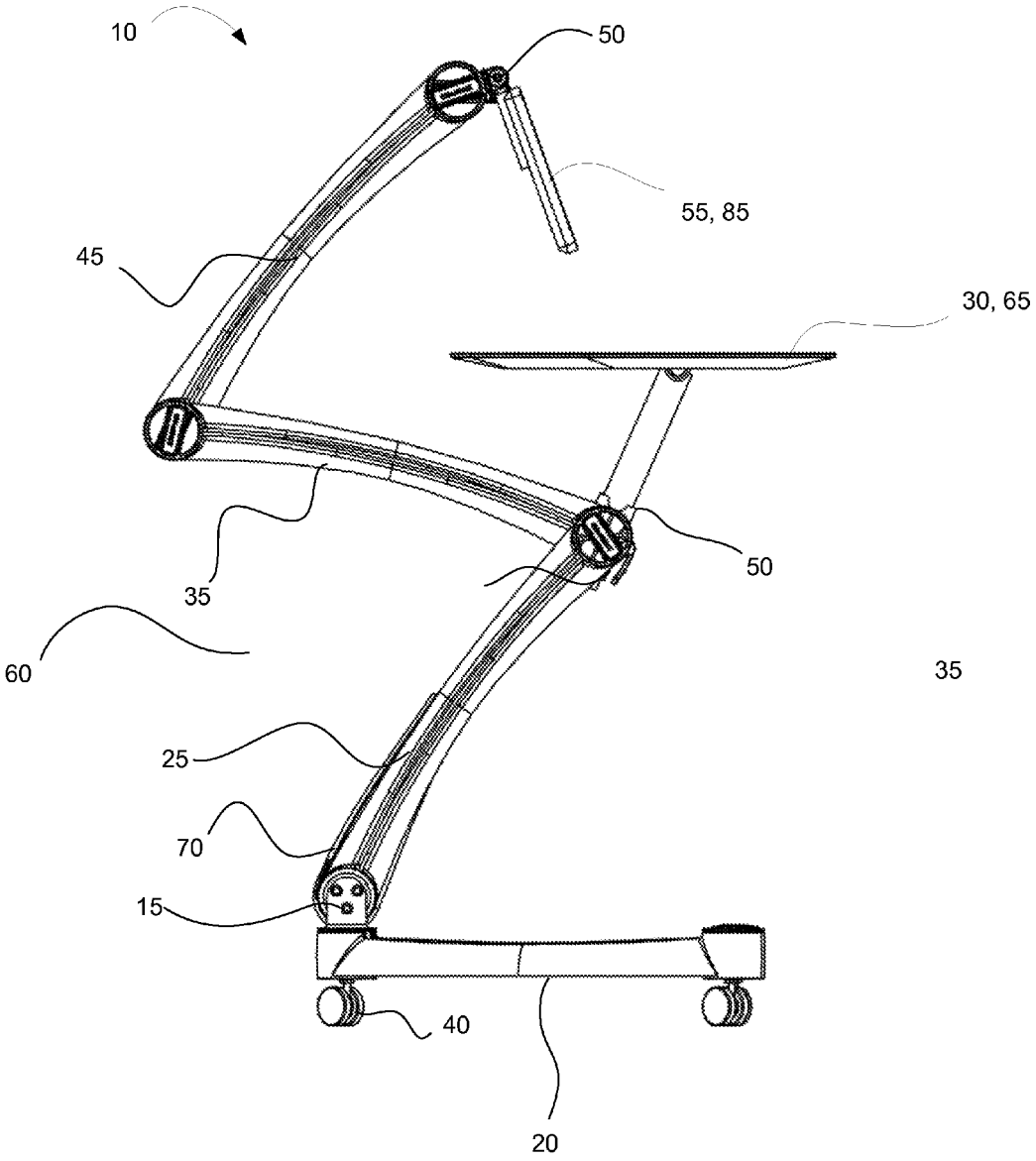
FIG. 2 is a side view of the work station.
Figure 3:
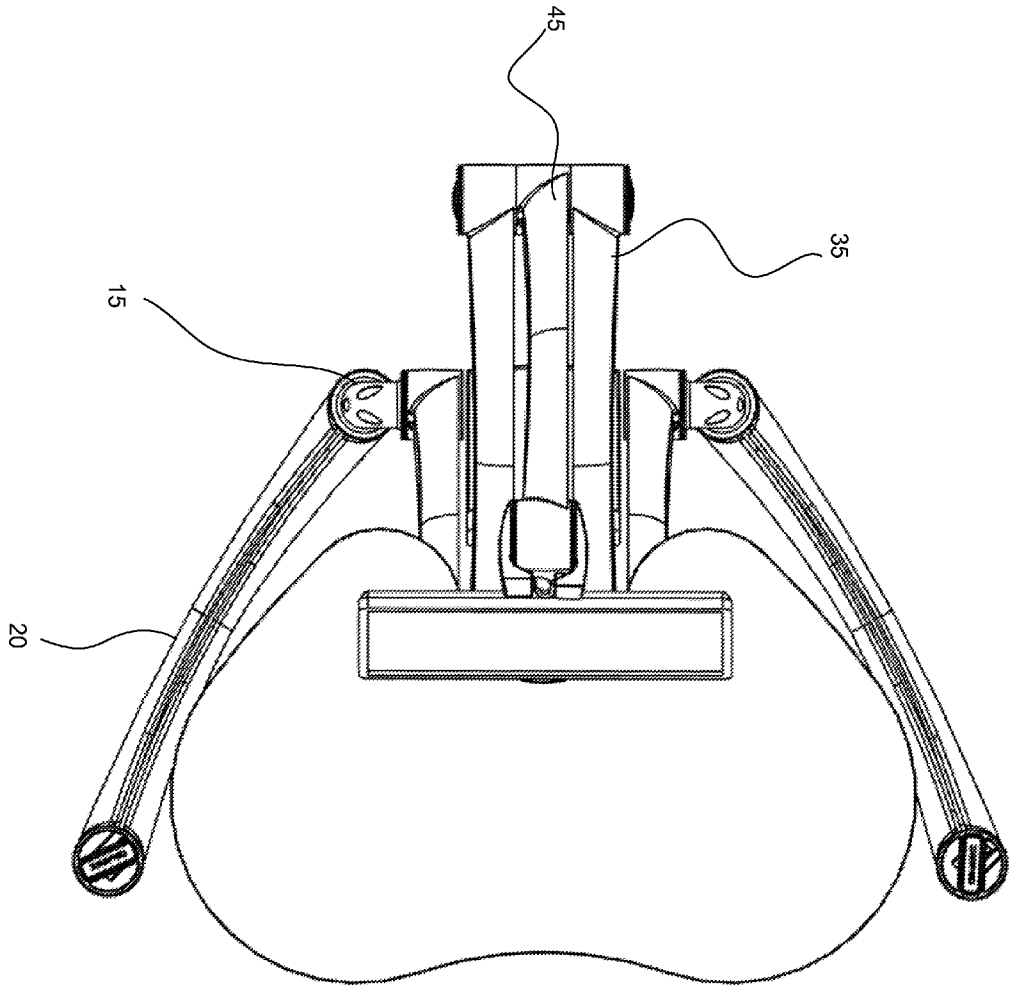
FIG. 3. is a top view of the work station.
Figure 4:
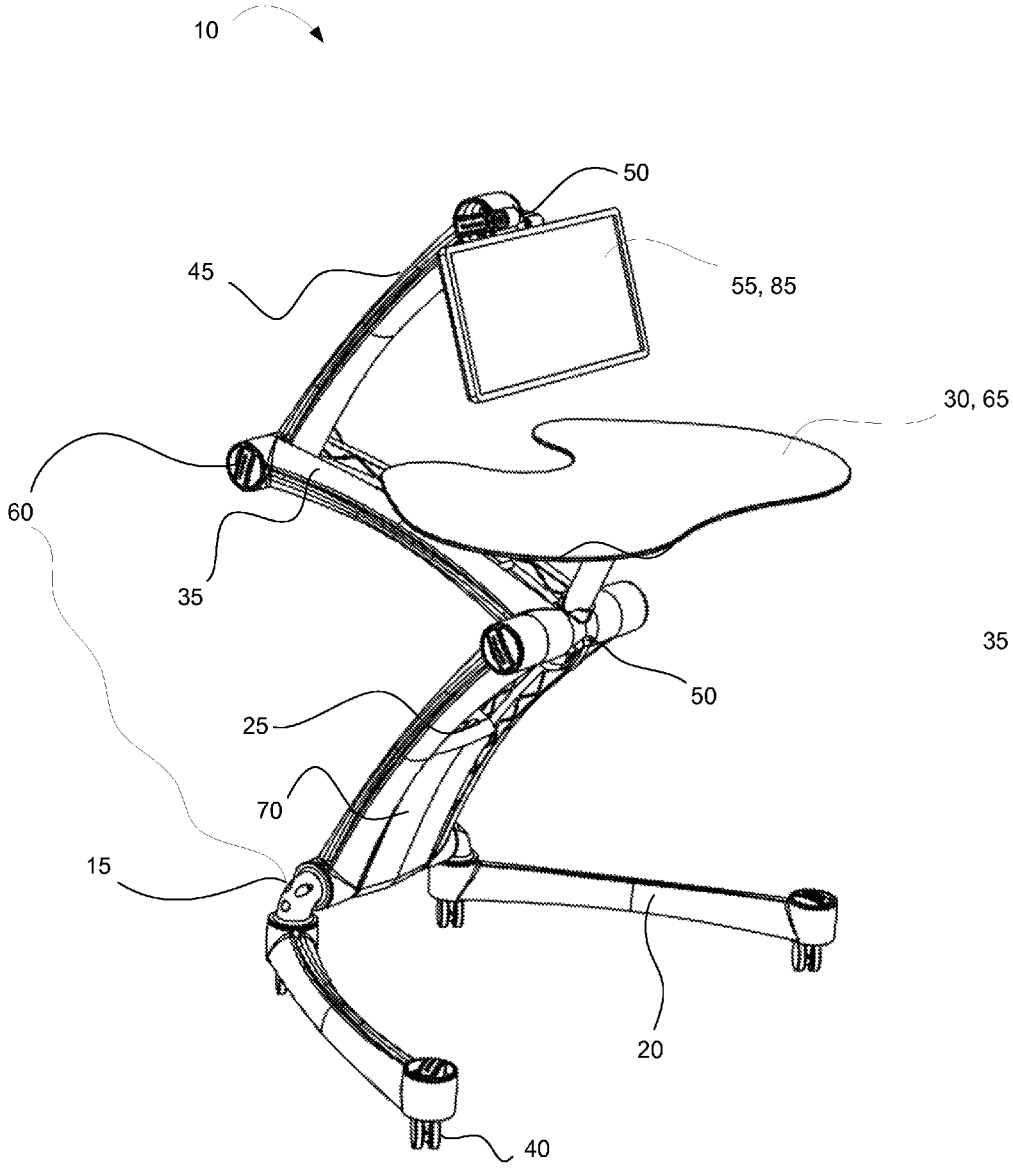
FIG. 4 is a perspective view of the work station.
Figure 5:
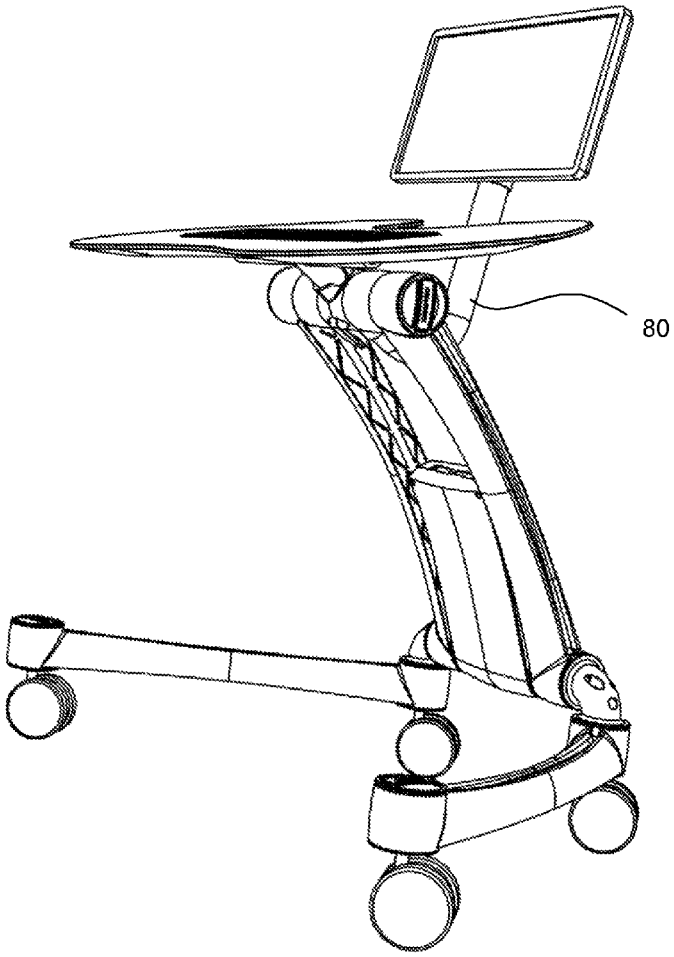
FIG. 5 is a perspective view of a variant of the work station.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

The present invention provides a convertible work station operable to convert between an operating configuration and a storage configuration. In one variant, referring to FIGS. 1-5, the workstation 10 may comprise right and left base shoulder elements 15 and right and left horizontal base members 20 for supporting the work station on a surface and are pivotally connected to the shoulder elements 15. The base members are constrained to pivot along a horizontal plane and are lockable in position relative to the shoulder elements 15.

Right and left first support members 25 are spaced apart from each other, parallel and have first and second ends. The support members are pivotally connected to the respective right and left shoulder elements 15 at their first ends and constrained to pivot in one direction and are fixed in position with respect to each other. The support members are lockable to a desired adjusted position relative to the shoulder elements. A work station component 30 is pivotally connected to the second ends of the right and left support members and is also lockable to a desired position.

As sown in FIGS. 24-27, the work station 10 converts between the operating and storage configuration via the pivotable connections between the shoulder elements and the support members 25 and base members 20.

In another variant of the convertible multimedia work station, the work station component comprises right and left second support arms 35 pivotally connected at their first ends to the respective seconds ends of the right and left first support members 25, and are constrained to pivot in the same plane as the first support members. The second support arms 35 are fixed in position relative to one another. Optionally, castors 40 may be provided on the base members 20. A third support arm 45 is pivotally connected at its first end between the right and left second support arms at their second ends. An attachment piece 50 is connected to the third support arm at its second end for connecting a work station object 55 to the work station. A plurality of locking mechanisms 60 for locking the pivotable connections in place are provided were the support members are connected. The locking mechanism 60 may be a quick release mechanism. An example is shown if FIG. 19-23. The work station converts between the operating and storage configurations via the pivotable connections.

In a further variant of the convertible work station, the work station component may be a platform 65 for supporting a keyboard and is connected to the work station between the first support arms 25 and the second support arms 35 at the second ends of the first support arms and the first ends of the second support arms.

Figure 16:
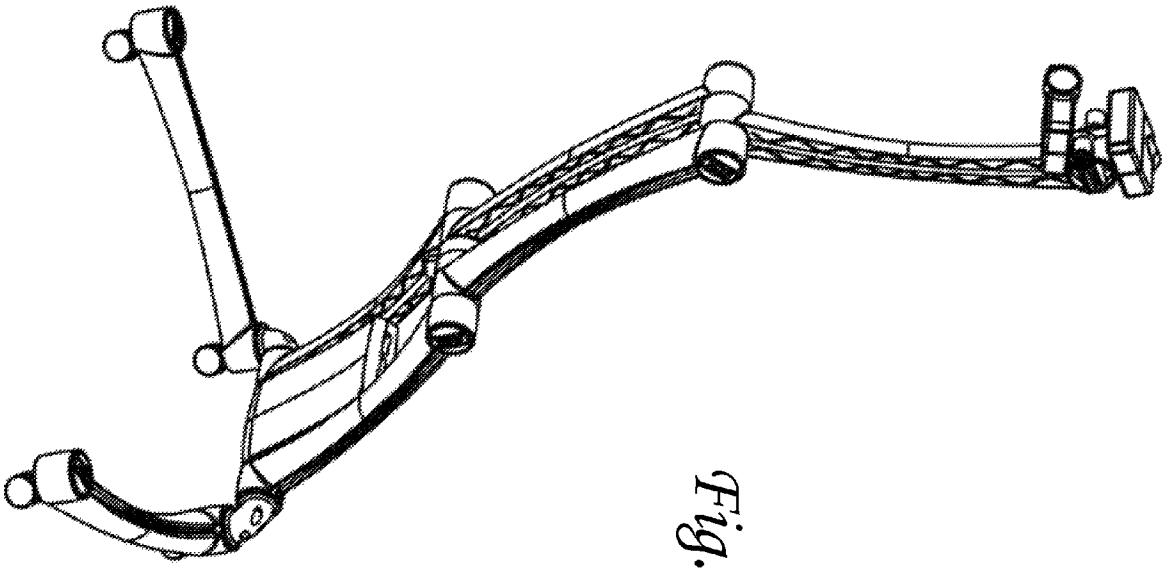
FIG. 16 is a perspective view of another variant of the work station having a projector.
Figure 17:
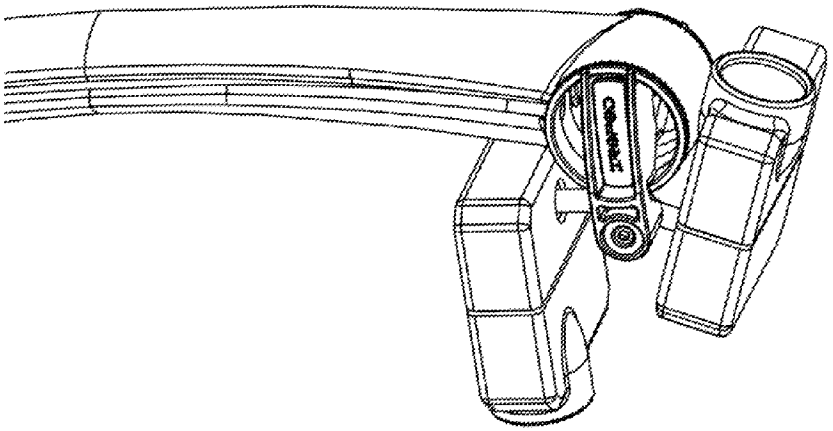
FIG. 17 is a close up view of another variant of the work station having a projector.
Figure 18:
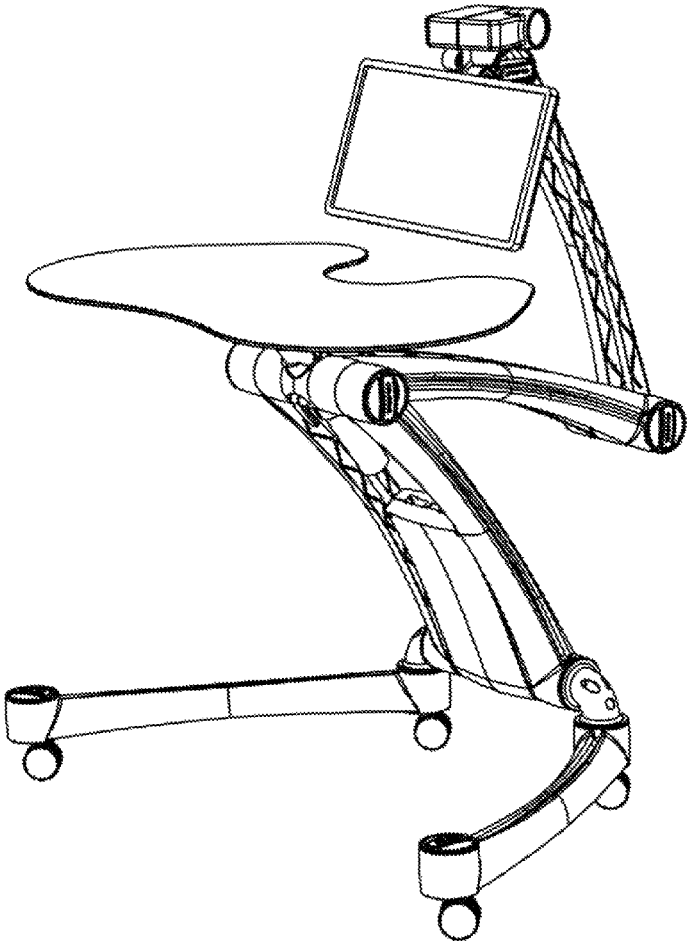
FIG. 18 is a perspective view of another variant of the work station having a projector and a display.
Figure 19:
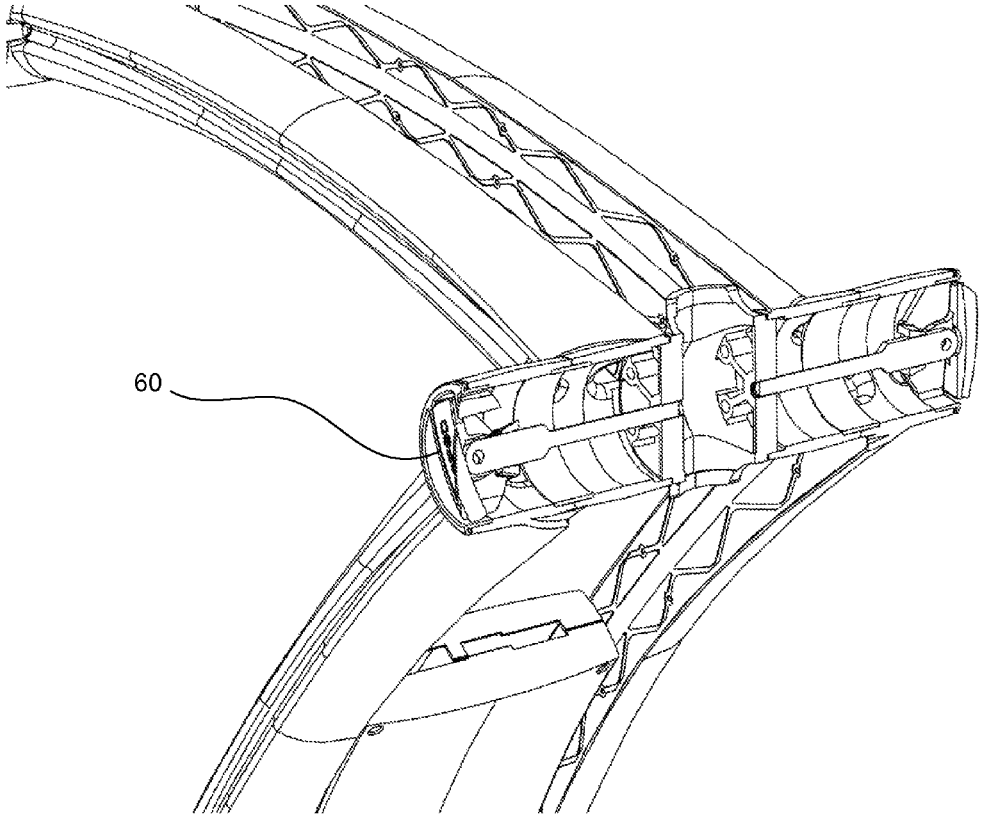
FIG. 19 is an exploded view of a variant of the locking mechanism for the joints between the support members.
Figure 20:
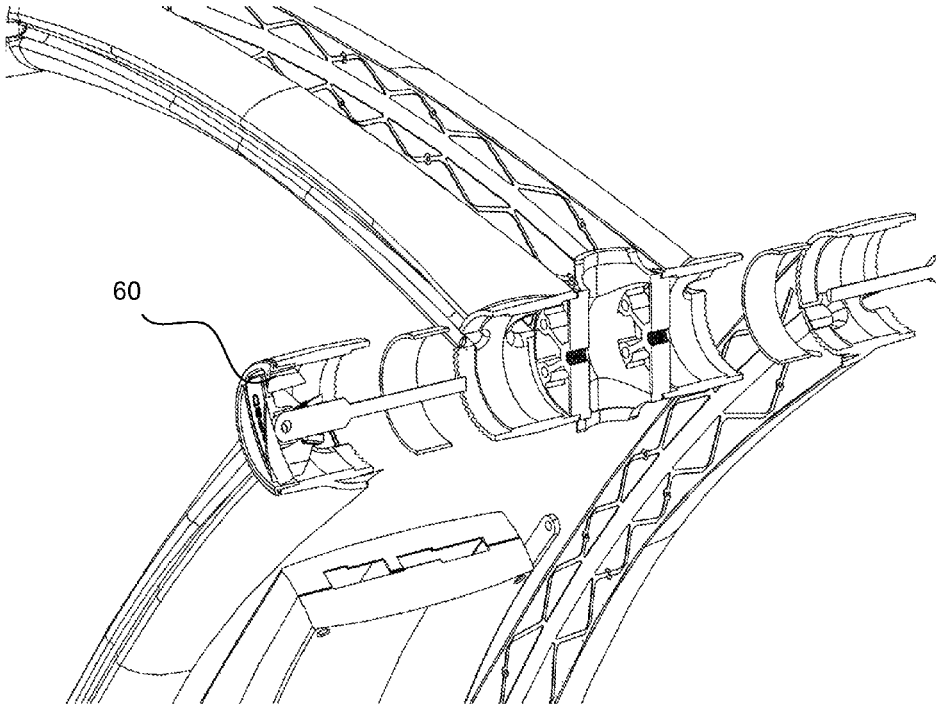
FIG. 20 is an exploded view of a variant of the locking mechanism for the joints between the support members.
Figure 21:
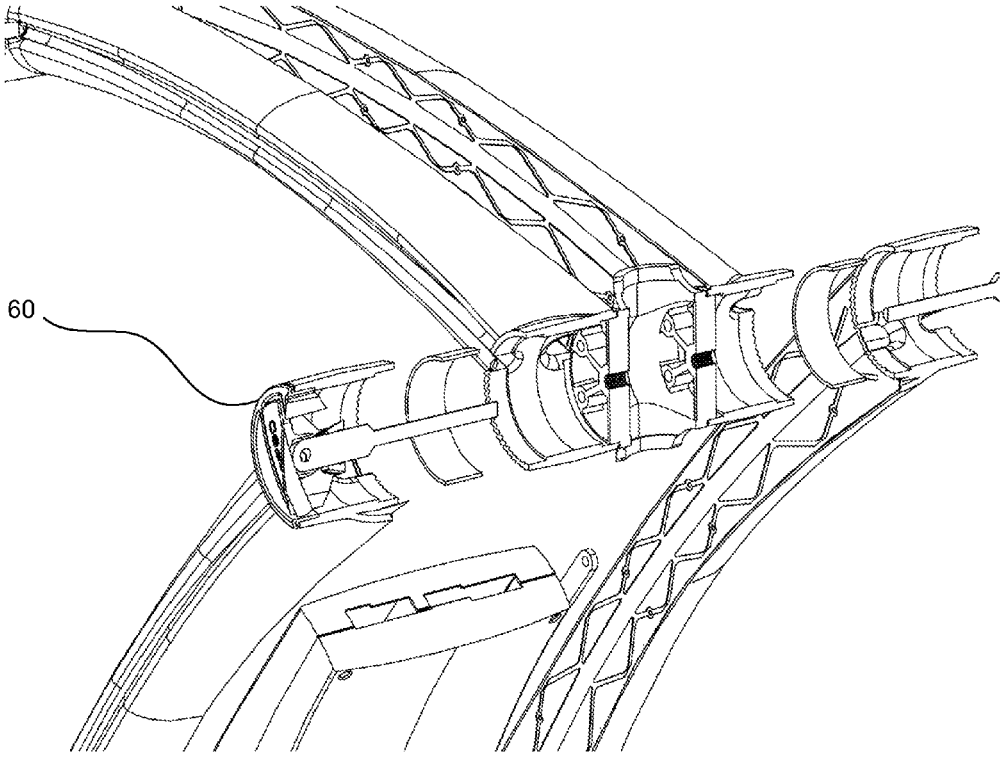
FIG. 21 is an exploded view of a variant of the locking mechanism for the joints between the support members.
Figure 22:
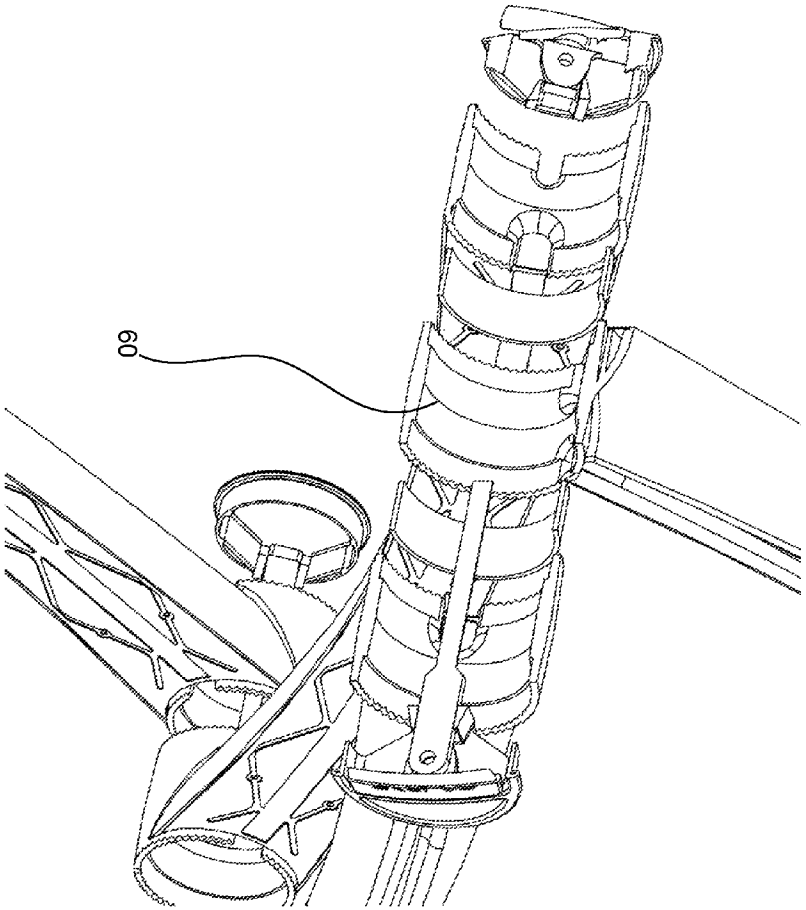
FIG. 22 is an exploded view of a variant of the locking mechanism for the joints between the support members.
Figure 23:
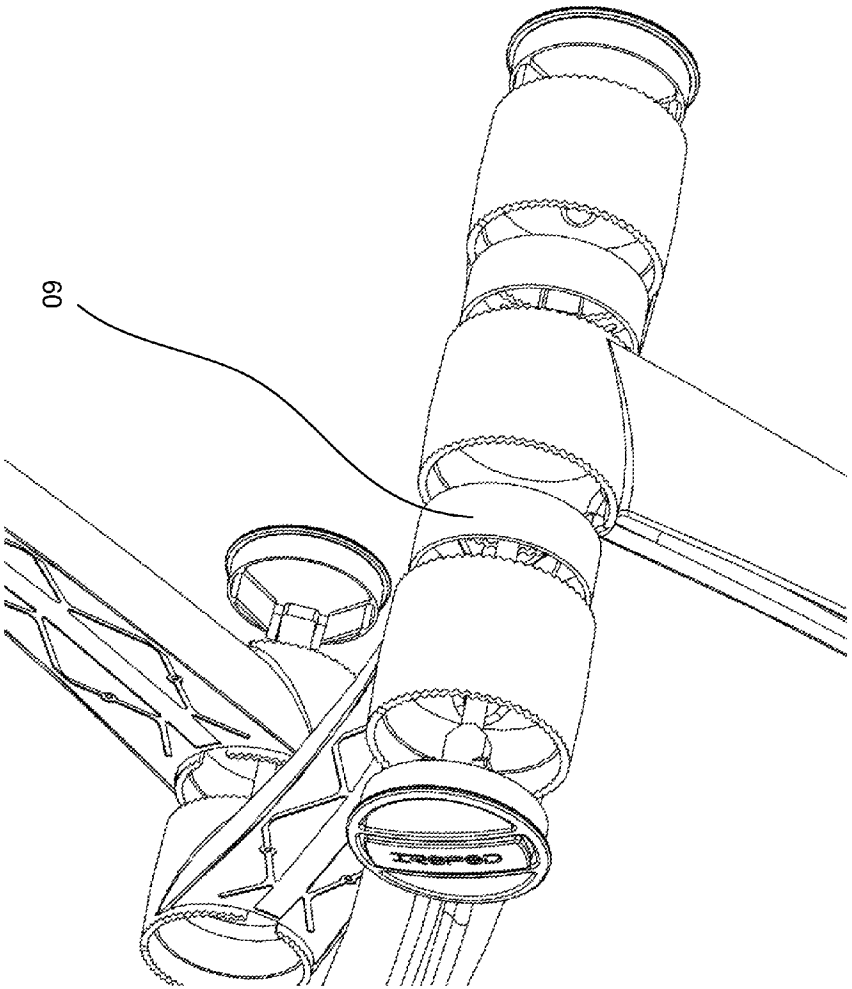
FIG. 23 is an exploded view of a variant of the locking mechanism for the joints between the support members.
Figure 24:
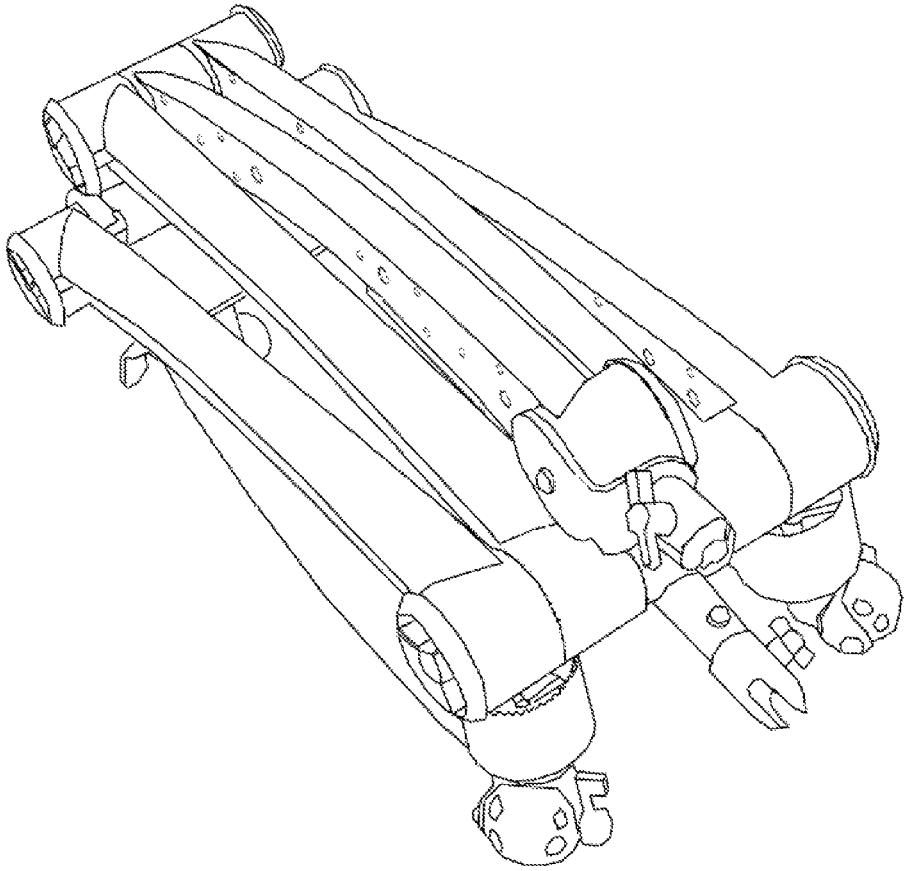
FIG. 24 is a perspective view of the work station in a storage configuration.
Figure 25:
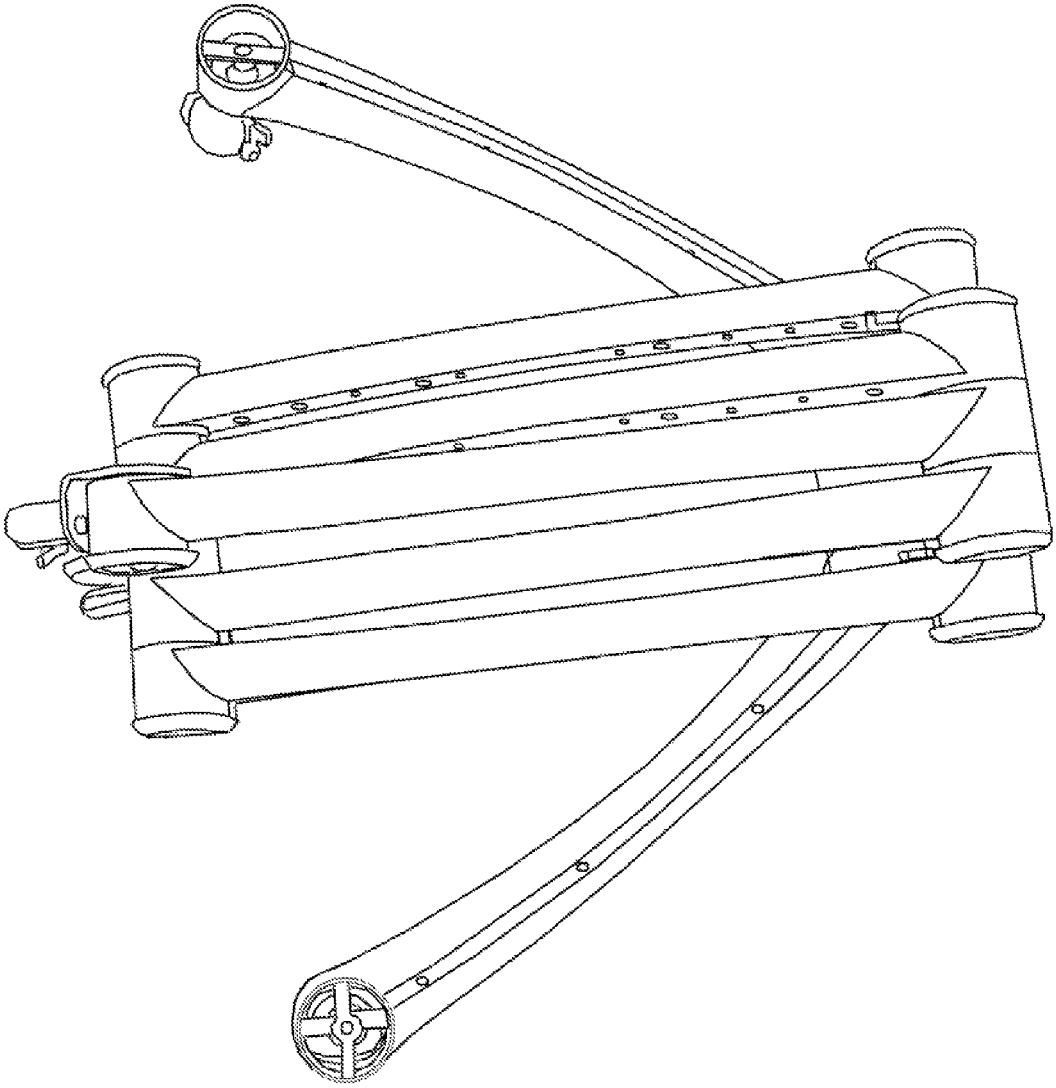
FIG. 25 is a perspective view of the work station in an intermediate configuration in converting from the storage to the operating configuration.
Figure 26:
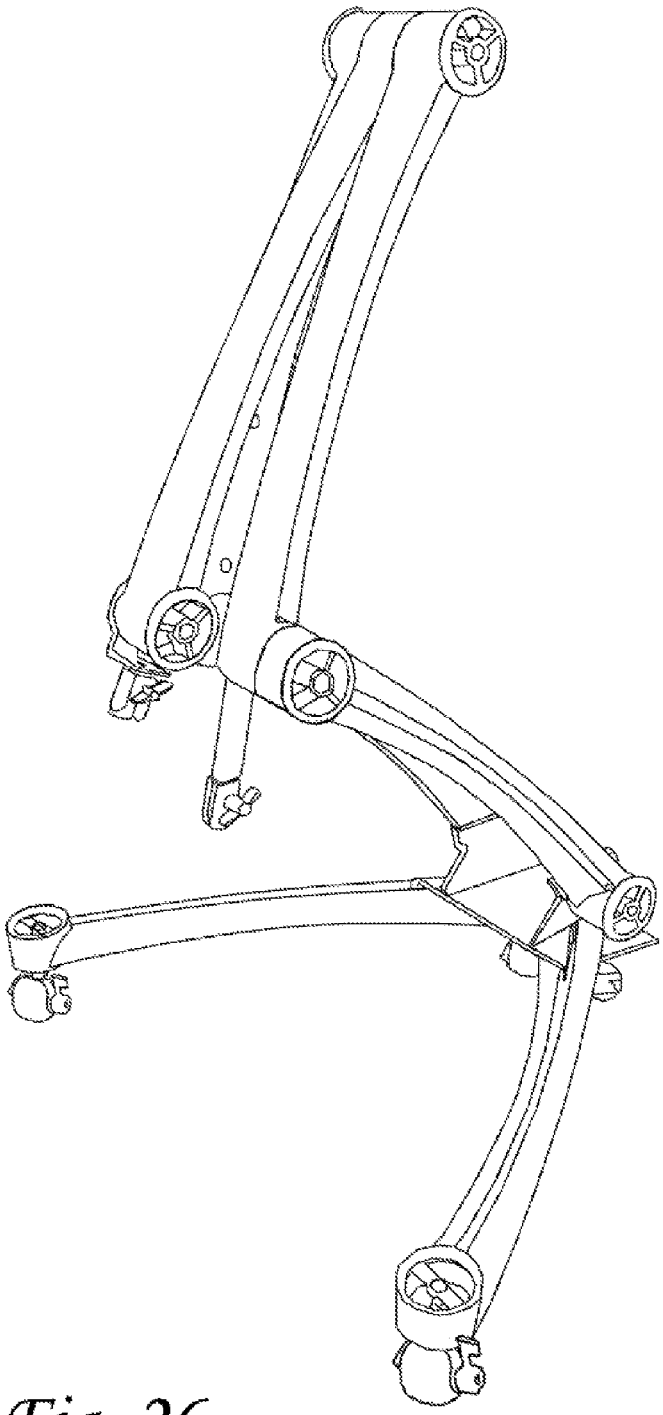
FIG. 26 is a perspective view of the work station in an intermediate configuration in converting from the storage to the operating configuration.
Figure 27:
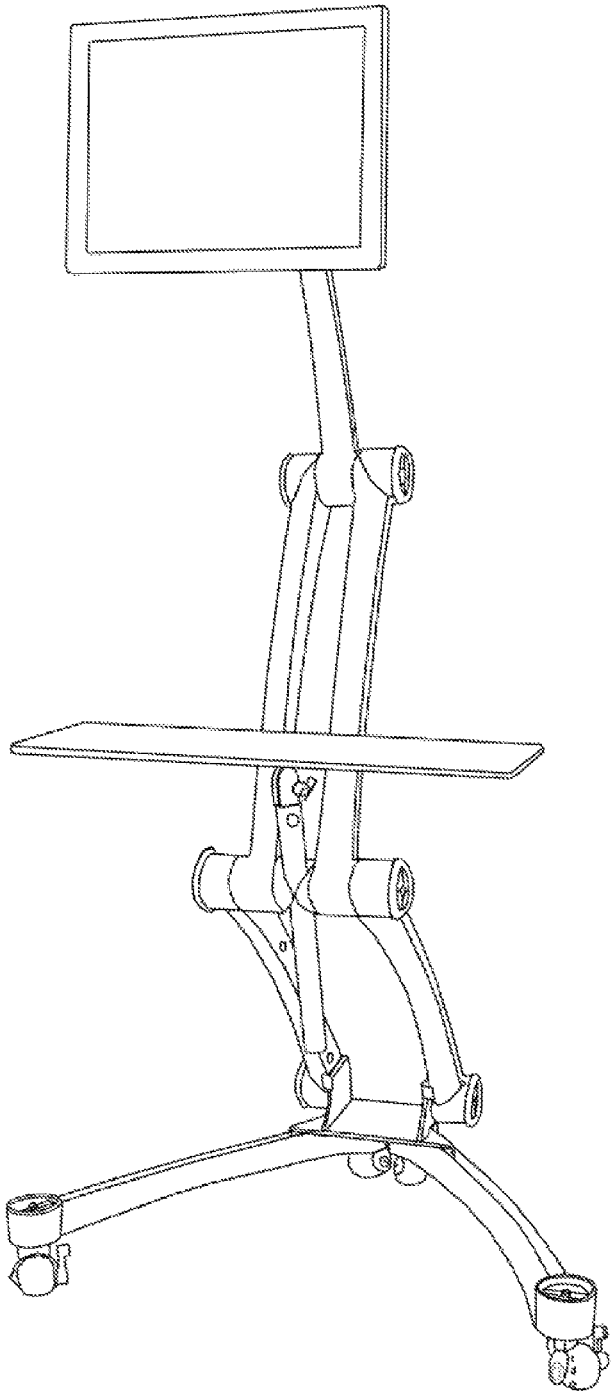
FIG. 27 is a perspective view of the work station in an operating configuration.

In still another variant, the convertible work comprises a display connected to the workstation between the first support arms and between the left and right shoulder elements. In a further variant, the convertible work station comprises a computer hardware case 70 containing a processing unit and memory, wherein the computer hardware case is connected to the workstation between the first support arms and between the left and right shoulder elements along a bottom edge of the hardware case. The case 70 may be constructed to fit between the support arms such that the thickness of the case is about the same thickness of the support arms to give the workstation so as to reduce bulkiness. Other variants, shown in FIGS. 16-18, include a projector or a combination projector and display.

Figure 6:
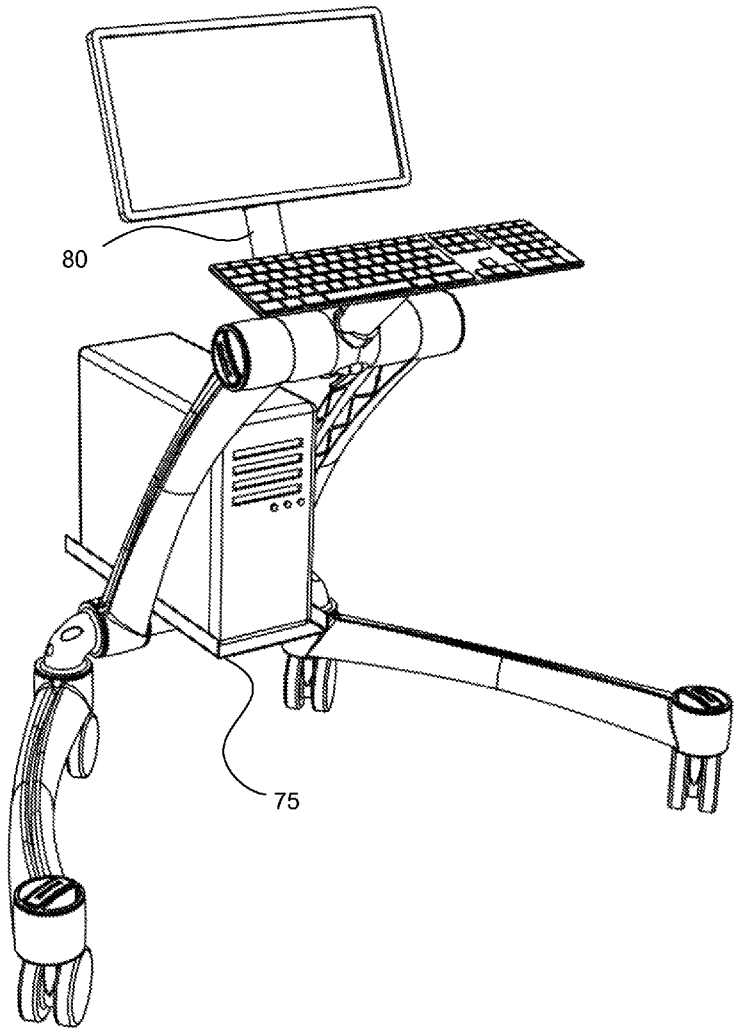
FIG. 6 is a front perspective view of a variant of the work station having a platform on the base for supporting a computer case.
Figure 7:
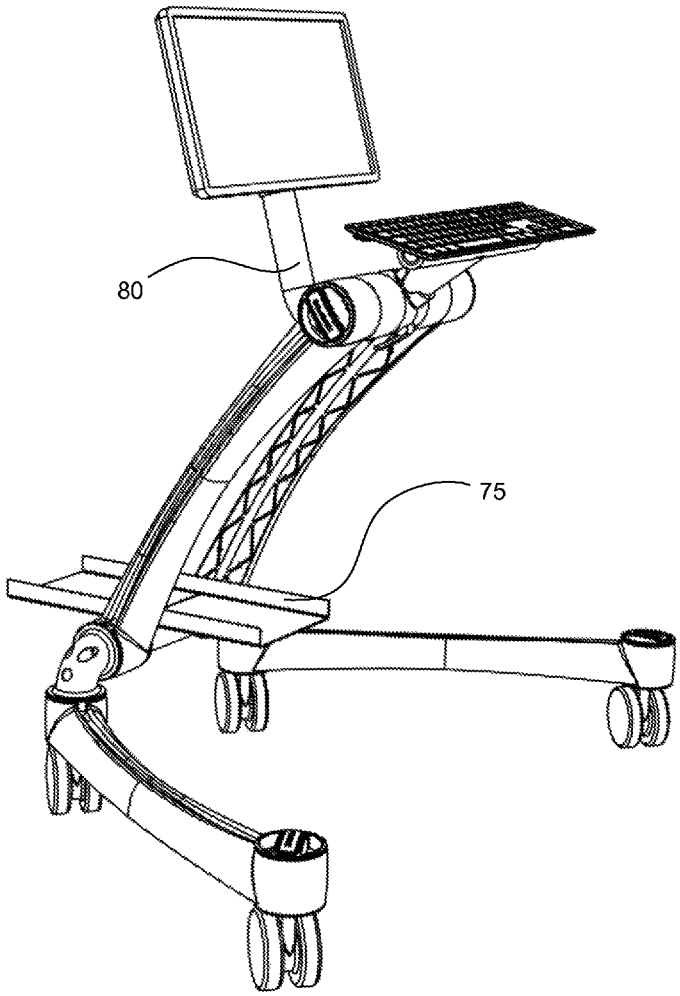
FIG. 7 is a front perspective view of a variant of the work station having a platform on the base for supporting a computer case.
Figure 8:
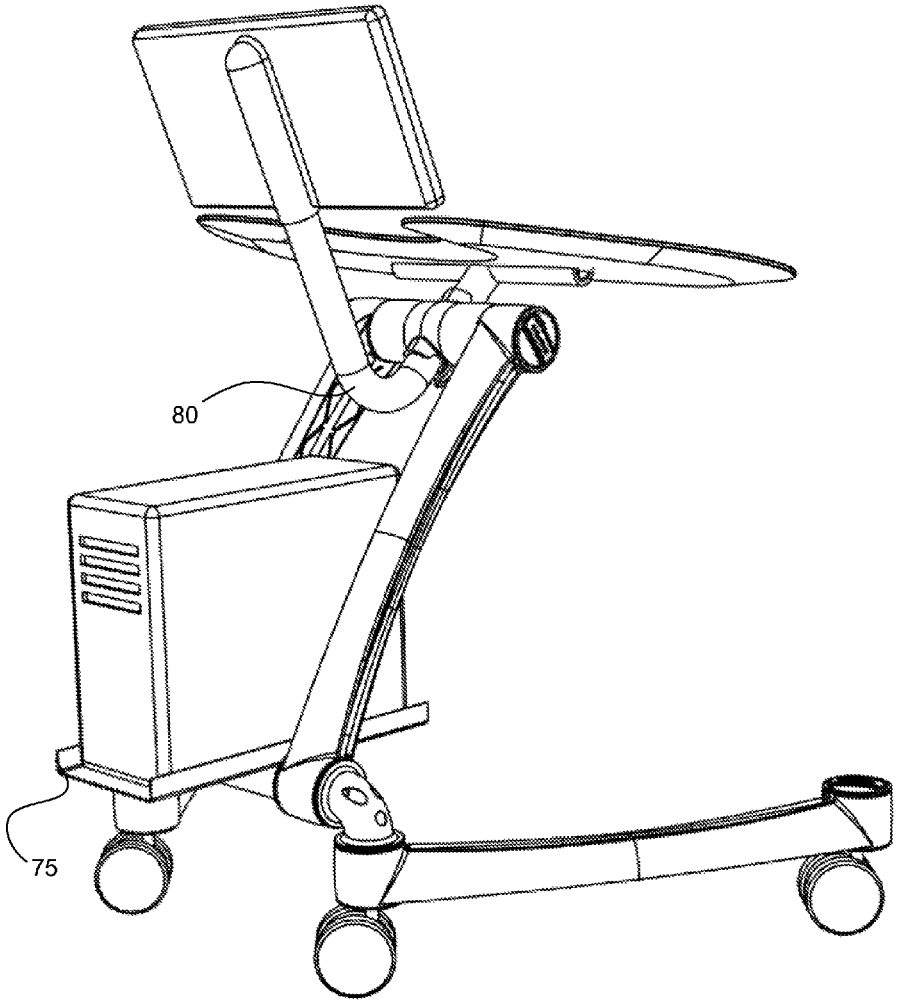
FIG. 8 is a rear perspective view of a variant of the work station having a platform on the base for supporting a computer case.
Figure 9:
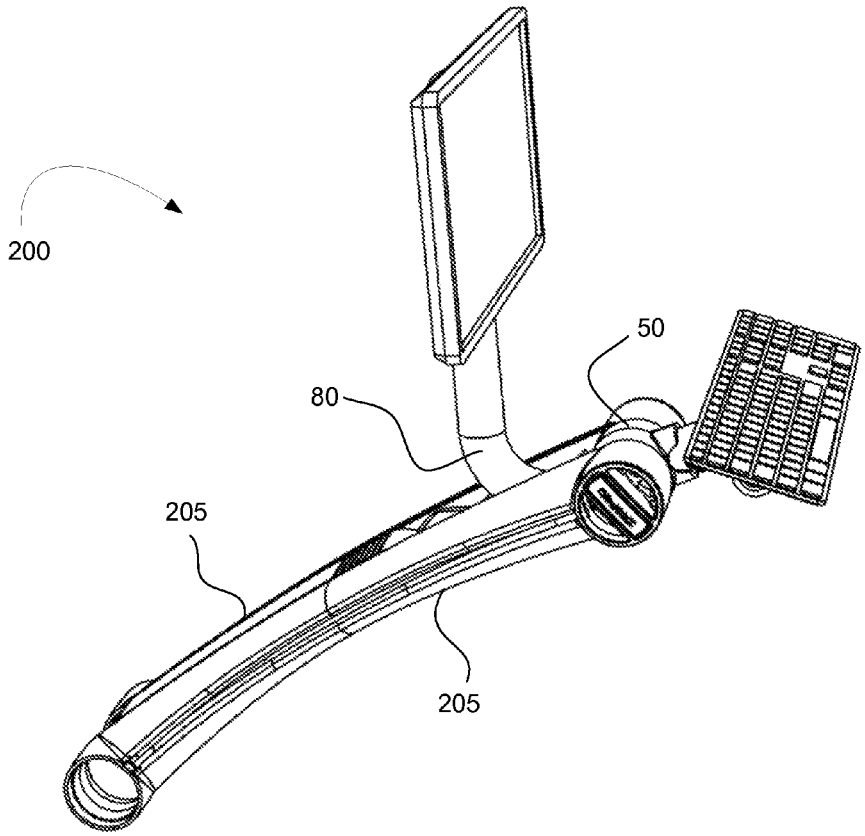
FIG. 9 is a right side perspective view of another variant of the work station for increasing available space.
Figure 10:
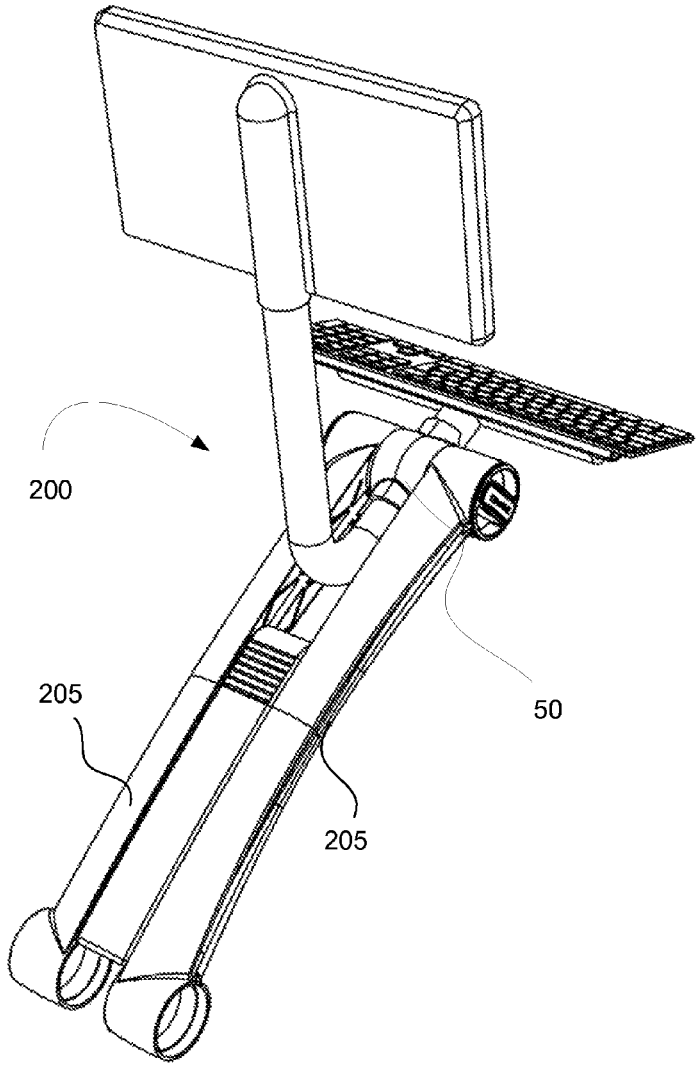
FIG. 10 is a rear perspective view of another variant of the work station for increasing available space.
Figure 11:
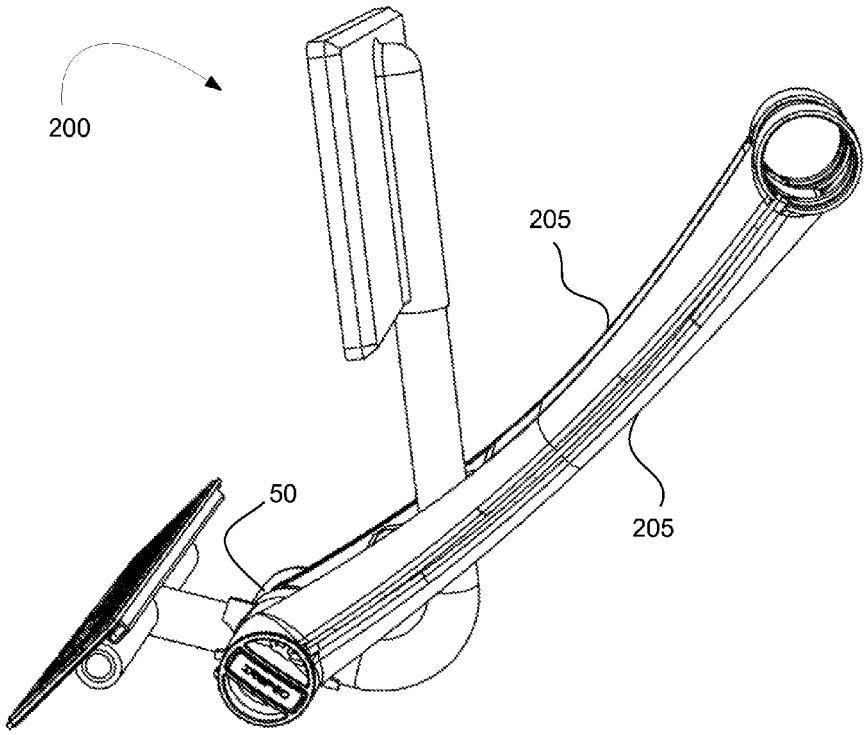
FIG. 11 is a left side perspective view of another variant of the work station for increasing available space.
Figure 12:
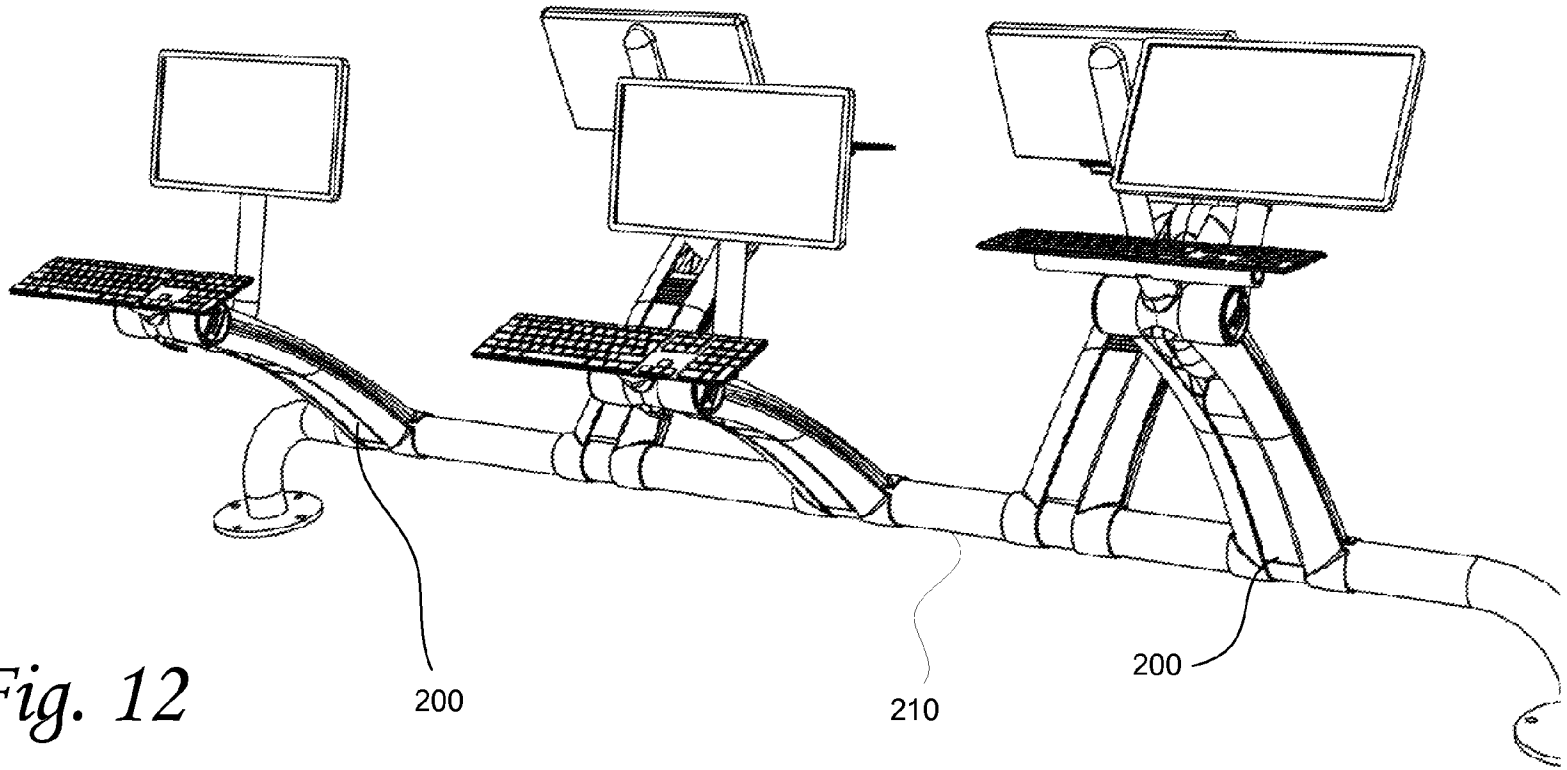
FIG. 12 is a perspective view of a plurality work stations for increasing available space.
Figure 13:
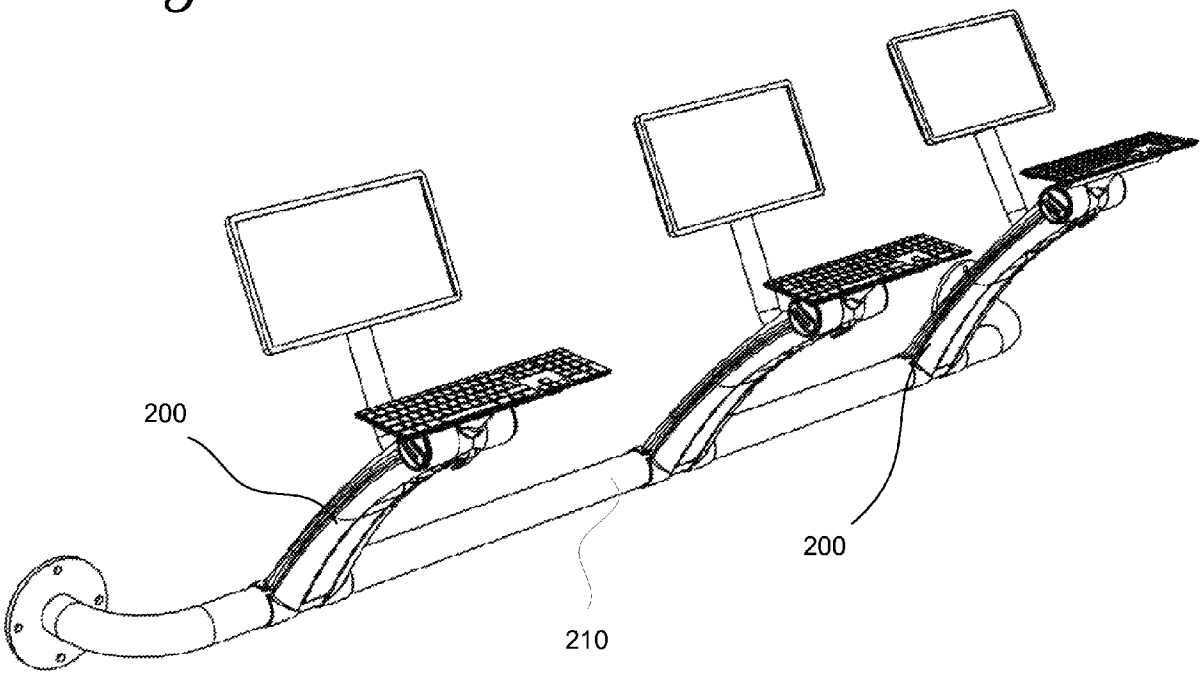
FIG. 13 is a perspective view of a plurality work stations for increasing available space.
Figure 14:
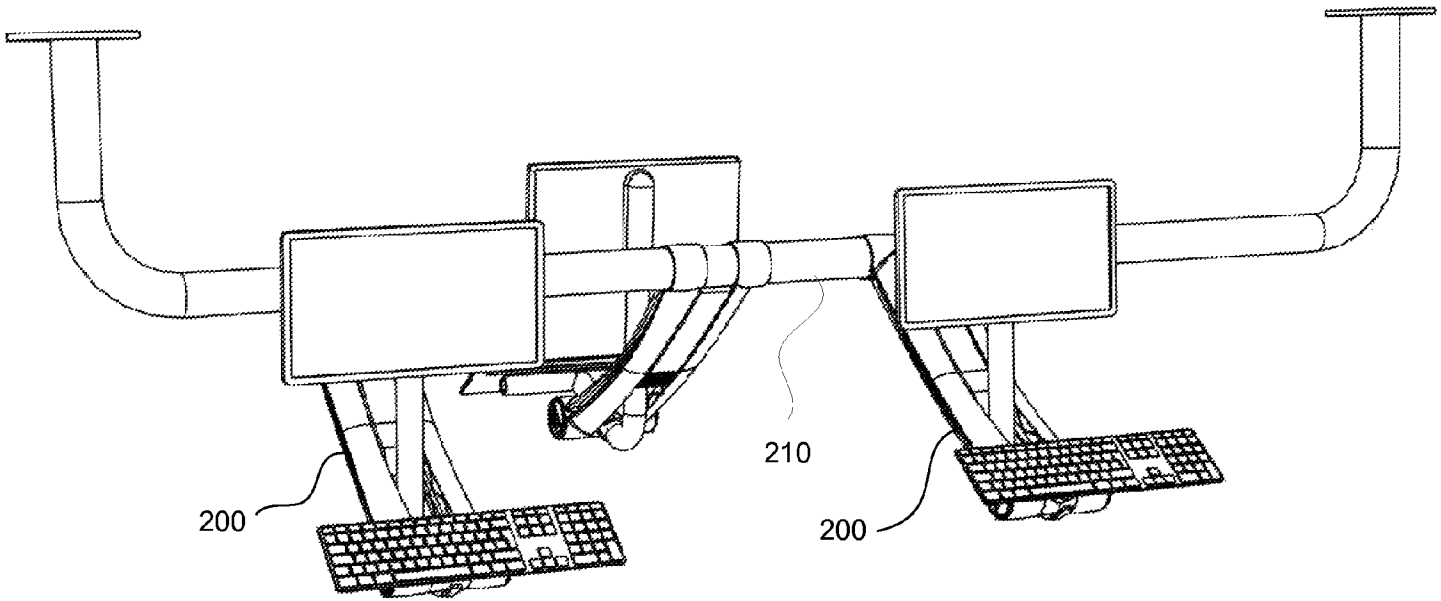
FIG. 14 is a perspective view of a plurality work stations for increasing available space.
Figure 15:
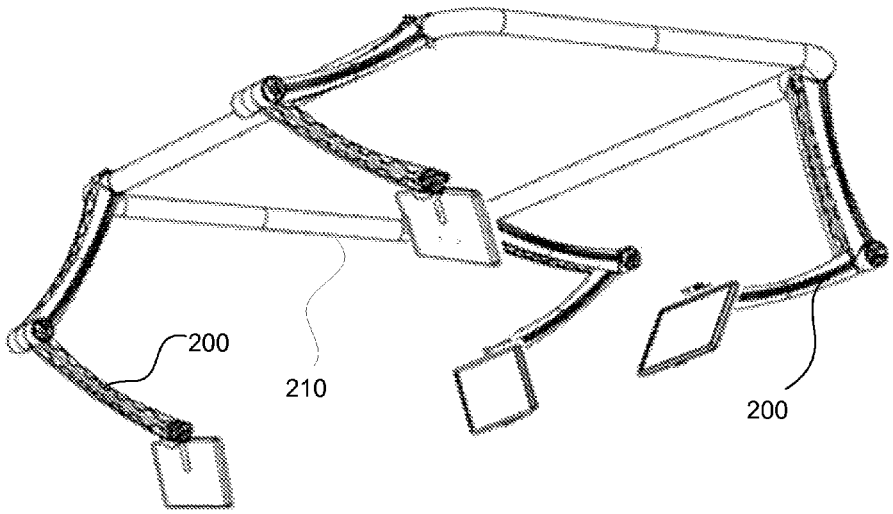
FIG. 15 is a perspective view of a ceiling mount of a plurality work stations for increasing available space.

In yet a further variant, referring to FIGS. 6-8, the convertible work station comprises a platform 75 connected to the workstation between the first support arms and between the left and right shoulder elements. The plat form is configured for the placement of computer hardware case.

In another variant of the convertible work station, the work station component 30 comprises a curved member 80 having two ends connected between the first support members, configured for attaching a work station object at either end of the curved member 80.

In a further variant of the convertible work station, the curved member 80 has one end attached to a display 85 and a second end to attached a platform 65. The curved member 80 is connected between the first and second support members and is pivotable between the first support members and lockable in a desired position.

Figure 28:
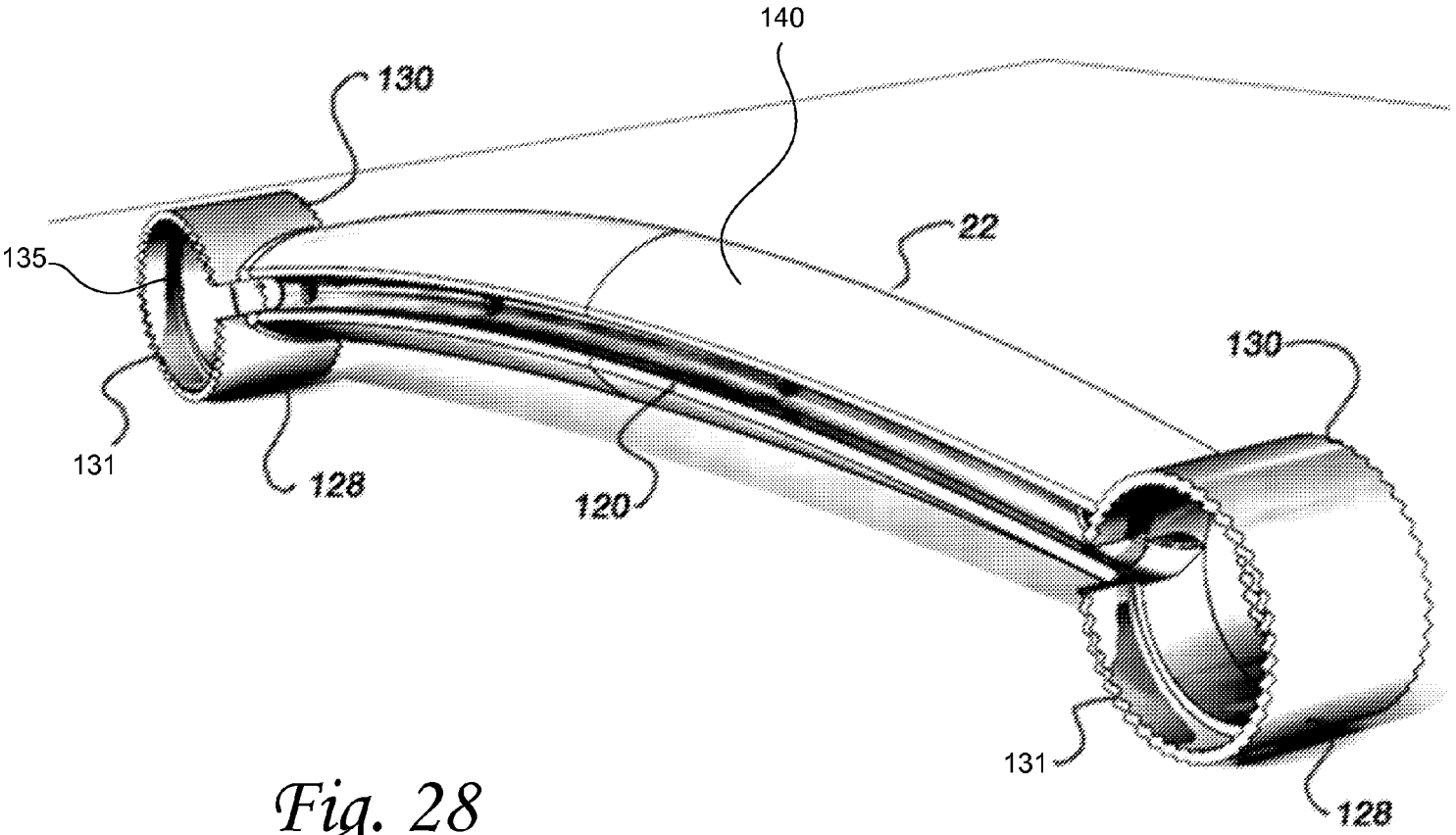
FIG. 28 is a perspective view of universal support member used to construct the work station in some embodiments.

In yet another variant, referring to FIG. 28 a universal support member 22 serves as a structural member in the work station, and comprises two identical ends 128. The ends have a first circular perimeter 130 configured for engaging another universal support member's end 128. The first circular perimeter defines a plane that faces perpendicular to a long dimension of the support member. A second circular perimeter 130 is configured for engaging another universal support member's end. The second circular perimeter also defines plane that is perpendicular to a long dimension of the support member. A hollow interior 135 in the support member allows passage between the first and second circular perimeters. A shaft 140 is connected between the ends and having a channel 120. The channel may be configured to allow wires (not shown) of various items that are attached to or rest on the work station 10 to recess in the channel 120 out of view. In one embodiment, the universal member 22 may be slightly bowed having saw tooth pattern disposed along the perimeter 130 of the ends.

In yet a further variant, referring to FIGS. 9-14, a work station 200 is configured to maximize space. In one embodiment, the work stations comprises a computer hardware case 70 containing a processing unit, memory and network hardware, and is disposed between the two support members 205. An attachment piece 50 is connected to the work station and disposed between the support members at first ends of the members and configured for connecting a display to the work station. A curved member 80 may connect and support the display and a platform for supporting a keyboard. The work station is preferably constructed with the universal support members described above.

In another variant, referring to FIGS. 12-15, a plurality of work stations 200 may be provided, wherein the work stations 200 are connected to a stationary support cylinder 210 at their second ends, through the circular circumferences 130. The work stations may further include a platform connected to an end of the attachment piece 50.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated. In addition, when a single callout line in the drawings leads to two or more separate reference numbers (first, second, etc. reference numbers), (and each reference numeral refers to a different piece of text in the detailed description) and it would be inconsistent to designate the drawing item being called out as both pieces of text, the drawing be interpreted as illustrating two different variants. In one variant, the drawing item is referred to by the first reference number and in another variant the drawing item is referred to by the second reference number, etc.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether CTRL logic or other components, can be combined in a single package or separately maintained and can further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A convertible work station, operable to convert between an operating configuration and a storage configuration, comprising:

right and left base shoulder elements;

right and left horizontal base members for supporting the work station on a surface, pivotally connected to the shoulder elements and constrained to pivot along a horizontal plane and lockable in position relative to the shoulder elements;

right and left first support members spaced apart from each other and having first and second ends, the support members being pivotally connected to the respective right and left shoulder elements at their first ends and constrained to pivot in one direction, the support members lockable in position relative to the shoulder elements; and a work station component pivotally connected to the second ends of the right and left support members;

wherein the work station converts between the operating and storage configuration via the pivotable connections between the shoulder elements and the support members and base members, each support member comprising two identical ends, each end comprising a first circular perimeter having a symmetrical pattern with mirror image symmetry configured for engaging another identical support member's end, the first circular perimeter defining a plane that faces perpendicular to a long dimension of the support member; a second circular perimeter having a symmetrical pattern with mirror image symmetry configured for engaging another identical support member's end, the second circular perimeter defining a plane that faces perpendicular to a long dimension of the support member; a hollow interior allowing passage between the first and second circular perimeters; and a curved shaft connected between the ends and having a channel that is open to the outside of the shaft and defining a trench, the trench continuous with the identical ends and each of the identical ends of the support member having a gap that is open to the outside of the support member where the trench meets each of the ends.

2. The convertible work station of claim 1, wherein the first support members are configured to pivot in one plane and wherein the work station component comprises:

right and left second support arms pivotally connected at their first ends to the respective seconds ends of the right and left first support members, and constrained to pivot in the same plane as the first support members are configured to pivot in;

third support arm pivotally connected at its first end between the right and left second support arms at their second ends; and an attachment piece connected to the third support arm at its second end for connecting a work station object to the work station;

a plurality of locking mechanisms for locking the pivotable connections in place;

wherein the work station converts between the operating and storage configurations via the pivotable connections.

3. The convertible multimedia work station of claim 2, wherein the work station component further comprises a platform connected to the work station between the first support arms at the second ends of the first support arms.

4. The convertible work station of claim 2, further comprising a display connected to the workstation between the first support arms and between the left and right shoulder elements.

5. The convertible multimedia work station of claim 1, further comprising a computer hardware case containing a processing unit and memory, wherein the computer hardware case is connected to the workstation between the first support arms and between the left and right shoulder elements along a bottom edge of the hardware case.

6. The convertible work station of claim 1, further comprising a platform connected to the workstation between the first support arms and between the left and right shoulder elements.

7. The convertible work station of claim 1, wherein the work station component comprises a curved member having two ends connected between the first support members, configured for attaching a work station object at either end of the curved member.

8. The convertible work station of claim 7, wherein curved member has one end attached to a display and a second end to attached a platform, the curved member connected between the first and second support members and is pivotable between the first support members and lockable in a desired position.

9. A universal support member comprising:

two identical ends, each end comprising:

a first circular perimeter having a symmetrical pattern with mirror image symmetry configured for engaging an identical universal support member's end, the first circular perimeter defining a plane that faces perpendicular to a long dimension of the support member;

a second circular perimeter having a symmetrical pattern with mirror image symmetry configured for engaging an identical universal support member's end, the second circular perimeter defining a plane that faces perpendicular to a long dimension of the support member;

a hollow interior allowing passage between the first and second circular perimeters; and a curved shaft connected between the ends and having a channel that is open to the outside of the shaft and defining a trench, the trench continuous with the identical ends and each of the identical ends of the support member having a gap that is open to the outside of the support member where the trench meets each of the ends.

10. A convertible work station constructed with universal support members of claim 9, operable to convert between an operating configuration and a storage configuration, comprising:

right and left base shoulder elements;

right and left horizontal base members for supporting the work station on a surface, pivotally connected to shoulder struts and constrained to pivot along a horizontal plane and lockable in position relative to the shoulder elements;

right and left first support members spaced apart from each other and having first and second ends, the support members being pivotally connected to the respective right and left shoulder elements at their first ends and constrained to pivot in one direction, the support members lockable in position relative to the shoulder elements; and a work station component pivotally connected to the second ends of the right and left support members;

wherein the horizontal base members and the first support members comprise the universal support member of claim 9;

wherein the work station converts between the operating and storage configuration via the pivotable connections between the should arms and the support members and base members.

11. A work station comprising:

two support members comprised of the support member of claim 9;

a computer hardware case containing a processing unit, memory and network hardware, disposed between the two support members;

an attachment piece connected to the work station and disposed between the support members at first ends of the members and configured for connecting a display to the work station.

12. A plurality of work stations of claim 11, wherein the work stations are connected to a stationary support cylinder at their second ends, the work stations further comprising a platform connected to an end of the attachment piece.

* * * * *